US006939281B2

(12) United States Patent
Bois

(10) Patent No.: US 6,939,281 B2
(45) Date of Patent: Sep. 6, 2005

(54) METHOD FOR MAKING BAGS COMPRISING SLIDER-ACTUATED CLOSURE PROFILES, MANUFACTURING MACHINE AND RESULTING BAGS

(75) Inventor: Henri Georges Bois, Neuilly sur Seine (FR)

(73) Assignee: S2F Flexico, Henonville (FR)

( * ) Notice: Subject to any disclaimer, the term of this patent is extended or adjusted under 35 U.S.C. 154(b) by 0 days.

(21) Appl. No.: 10/312,756

(22) PCT Filed: May 15, 2002

(86) PCT No.: PCT/FR02/01633

§ 371 (c)(1),
(2), (4) Date: Jul. 16, 2003

(87) PCT Pub. No.: WO02/092434

PCT Pub. Date: Nov. 21, 2002

(65) Prior Publication Data

US 2004/0014576 A1 Jan. 22, 2004

(30) Foreign Application Priority Data

May 15, 2001 (FR) ..... 01 06367

(51) Int. Cl.[7] ..... B31B 1/84
(52) U.S. Cl. ..... 493/213; 493/214; 493/927
(58) Field of Search ..... 493/212, 213, 493/214, 114, 394, 927

(56) References Cited

U.S. PATENT DOCUMENTS 4,829,745 A * 5/1989 Behr et al. ..... 53/451
4,876,842 A 10/1989 Ausnit
5,111,643 A * 5/1992 Hobock ..... 53/551
5,174,657 A 12/1992 Peppiatt
6,477,821 B1 * 11/2002 Bois ..... 53/412

FOREIGN PATENT DOCUMENTS

FR 2778362 11/1999

* cited by examiner

*Primary Examiner*—Sameh H. Tawfik
(74) *Attorney, Agent, or Firm*—Finnegan, Henderson, Farabow, Garrett & Dunner, L.L.P.

(57) ABSTRACT

A method of automatically forming bags fitted with complementary closure strips secured to distinct support webs and associated with an actuating slide, in which method: at least one film suitable for forming the walls of the bags is supplied continuously; a closure assembly comprising complementary closure strips secured to distinct lateral support webs which extend beyond the closure strips is supplied continuously, the strips being associated with slides for actuating the closure strips, which slides are distributed along the length of the closure assembly as supplied; the closure assembly formed in this way is fixed via the external lateral support webs to the film forming the wall of the bags; the method being characterized in that: a loop is made in the continuously supplied film; and inside the concave portion of the loop the closure assembly is fixed to the surface of the film that corresponds to the outside surface of the bags.

15 Claims, 3 Drawing Sheets

HORIZONTAL

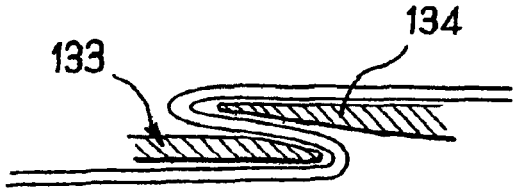
FIG_4
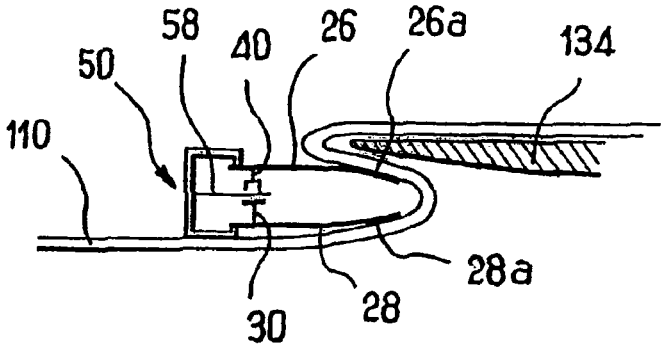
FIG_5
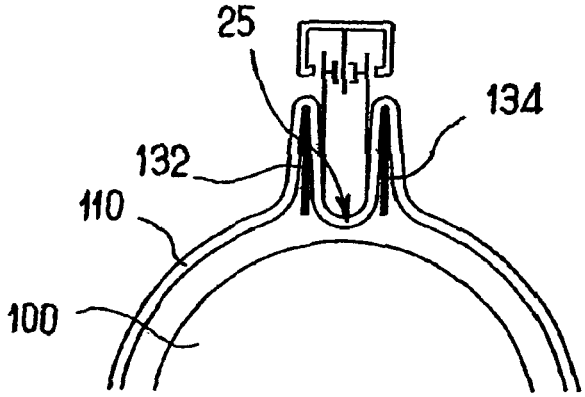
FIG_6
FIG_7
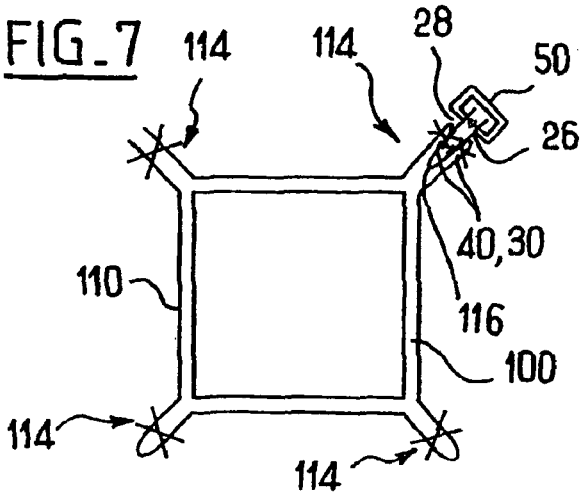
FIG_8
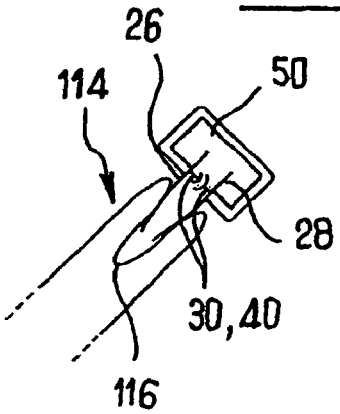

METHOD FOR MAKING BAGS COMPRISING SLIDER-ACTUATED CLOSURE PROFILES, MANUFACTURING MACHINE AND RESULTING BAGS

This application is a 371 of PCT/FR02/01633 May 15, 2002.

GENERAL TECHNICAL FIELD AND STATE OF THE ART

The present invention relates to the field of bags having complementary closure strips designed to enable a user to perform successive opening and closing operations.

Numerous types of bag and/or closure strip have already been proposed for this purpose.

By way of non-limiting example, reference may be made to the following documents: U.S. Pat. No. 4,929,225, U.S. Pat. No. 4,892,414, EP-0 562 774, EP-0 395 362, U.S. Pat. No. 5,382,094, U.S. Pat. No. 3,181,583, EP-0 728 665.

Still more precisely, the present invention relates to the field of bags having closure strips which are opened and closed by means of a slide.

Various types of bag with slide-actuated closure strips have also been proposed.

By way of example, reference may be made on this point to the document FR-2 778 362.

Compared with bags that have no slide, bags having slide-actuated closure strips present the enormous advantage of being easy to handle.

The slide makes it easier to separate the strips when opening the bags, and conversely makes it easy to engage the strips when closing said bags. This can be done merely by moving the slide in translation along the strips.

Attempts have indeed been made to facilitate the handling of strips that do not have a slide, in particular by providing ribs on the walls of bags fitted with such strips so as to make it easier to find the strips by touch. Nevertheless, those dispositions do not give complete satisfaction compared with slide-fitted bags. Firstly making such ribs complicates the production installation. Secondly, such ribs are not as easy to locate and to actuate as a slide.

Nevertheless, in practice, it has been found that bags fitted with slide-actuated closure strips have not yet benefited from major industrial development.

This would appear to be due in particular to the fact that it is difficult to implement slide-actuated closure strips on conventional machines for automatically forming and/or filling bags. The slides give rise to extra thickness which makes moving the strips and/or films fitted therewith very difficult on automatic machines.

As described in documents EP-0 051 010, EP-0 102 301, and EP-0 479 661, proposals have been made for this reason to add slides to the strips after the closure strips have themselves been fitted to the films making up the bag. Nevertheless, those dispositions generally require relative complex equipment to feed the slides, to open them, and then to close them onto the closure strips, while ensuring that the slides are precisely positioned on the closure strips, and as a general rule while also running continuously.

Document FR-2 778 362 proposes a machine for automatically forming bags fitted with complementary closure strips, as shown in FIG. 1. The machine comprises: a forming throat 100 which receives a film 110 in the plane state coming from an unwinder 112, and which delivers the film 110 shaped into a tube; a filler chute 120 which opens out into the forming throat 100 and consequently into said tube; longitudinal heat-sealing means 130 for closing the tube longitudinally; and means 140 suitable for acting sequentially to generate a first transverse line of heat sealing prior to a product being inserted into the tube via the filler chute 120, and then a second transverse line of heat sealing once the product has been inserted into the tube, thereby closing a package around the product.

The machine also has means suitable for delivering a continuously running closure assembly 10 comprising a W-shaped support sheet constituting firstly an internal tamperproofing ribbon of channel section provided on its facing inside surfaces with respective complementary closure strips, and secondly outer lateral webs which extend beyond the closure strips of the internal channel section ribbon, the closure assembly 10 also being pre-fitted with a series of slides 50 for actuating the closure strips, which slides are distributed along the closure assembly as delivered, the means 130 being suitable for fixing the resulting closure assembly 10 via its outer lateral support webs to the free longitudinal edges of the film 110 forming the wall of the bag.

Nevertheless, the above techniques present drawbacks.

The closure strips fitted with their slide are fixed to the free edges of the plastics film, i.e. in register with the longitudinal line of heat sealing that closes the tube longitudinally. As a result the closure strips and the associated slides disturb the heat sealing and closure of the bags, in particular because of the extra thickness they constitute.

SUMMARY OF THE INVENTION

The invention seeks to mitigate those drawbacks.

To this end, the invention provides a method of automatically forming bags fitted with complementary closure strips secured to distinct support webs and associated with an actuating slide, in which method:

at least one film suitable for forming the walls of the bags is supplied continuously;

a closure assembly comprising complementary closure strips secured to distinct lateral support webs which extend beyond the closure strips is supplied continuously, the strips being associated with slides for actuating the closure strips, which slides are distributed along the length of the closure assembly as supplied;

the closure assembly formed in this way is fixed via the external lateral support webs to the film forming the wall of the bags;

the method being characterized in that:

a loop is made in the continuously supplied film; and inside the concave portion of the loop, the closure assembly is fixed to the surface of the film that corresponds to the outside surface of the bags.

Advantageously, the invention also has the following characteristics taken singly or in any technically feasible combination:

the method is implemented on an automatic bag-forming machine in which the bags travel horizontally;

it is implemented on an automatic bag-forming machine in which the bags travel vertically;

it is implemented on an automatic machine for forming, filling, and sealing bags;

the closure assembly is fixed to the surface of the film prior to the plastics film traveling over a horizontally traveling automatic bag forming machine;

the loop is made in the continuously traveling film by fingers fixed to the structure of the machine and extending in a mutually alternating configuration so as to impart a substantially W-shaped shape to the loop;

the pitch of the slides along the closure assembly is equal to the size of the bags to be formed;

the closure assembly is fed parallel to the travel direction of the film;

the closure strips are mutually engaged (closed) while the film is being fixed;

the closure assembly includes pre-seals at a constant pitch for bonding together the complementary closure strips prior to being fed to the automatic bag-forming machine;

the pitch of the pre-seals is equal to the size of the bags; and the closure strips are mutually engaged (closed) between the slide and one of the pre-seals and disengaged (open) between the slide and the other adjacent pre-seal.

The present invention also provides a machine for forming bags and the resulting bags.

DESCRIPTION OF THE FIGURES

Other characteristics and advantages of the invention appear from the following description which is purely illustrative and non-limiting and which should be read with reference to the accompanying drawings, in which:

FIG. 4 is a section view of another possible implementation of a loop in the film prior to fixing the fixing assemblies and prior to causing the film to travel over the forming throat;

FIG. 5 is a section view of a loop to which the fixing assembly has been fixed prior to causing the film to travel over the forming throat;

FIG. 6 is a section view of a loop as shown in FIG. 5 as it is traveling over the forming throat;

FIG. 7 is a diagrammatic cross-section view of a particular embodiment of a forming throat in accordance with the present invention; and FIG. 8 is a view on a larger scale showing an implementation detail of the invention in this context.

DESCRIPTION OF A PREFERRED EMBODIMENT

As mentioned above, the present invention relates to using an automatic machine to form reclosable bags having slide-actuated closure strips.

The present invention can be applied equally well to automatic bag-forming machines that travel horizontally and to automatic bag-forming machines that travel vertically.

Furthermore, the present invention applies equally well to machines for automatically forming bags with filling taking place in a step subsequent to forming, possibly at a site that is geographically remote from the forming site, and to machines that form, fill, and close bags at a single site during successive steps.

Thus, the present invention applies preferably, but in non-limiting manner, to machines for automatically forming, filling, and sealing bags, and most advantageously to such machines in which the bags travel vertically.

A description of such machines for automatically forming, filling, and sealing vertically-traveling bags can be found in the documents cited in the state of the art in the present application. Reference can be made advantageously to FIG. 1 to understand how such machines operate.

Figure 1:
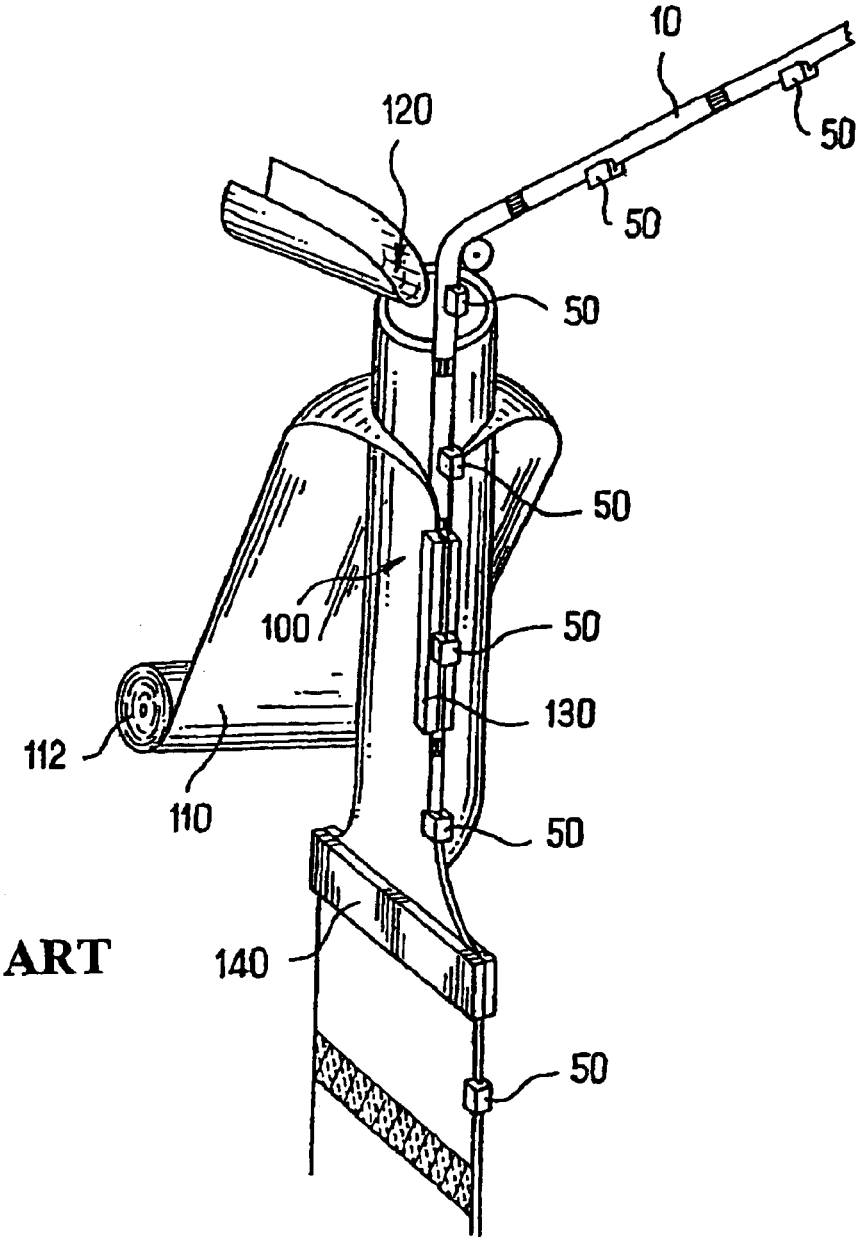
PRIOR ART FIG 1
FIG. 1 is a perspective view of a prior art automatic forming machine.
Figure 2:
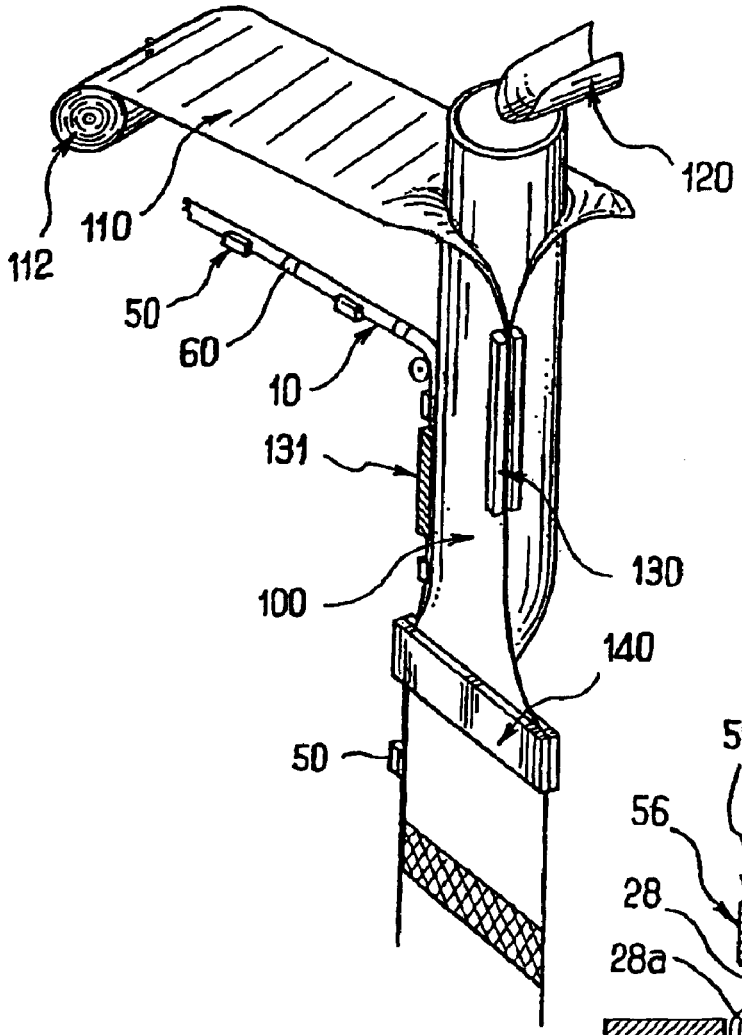
FIG. 2 is a perspective view of one possible embodiment of an automatic forming machine of the invention.
Figure 3:
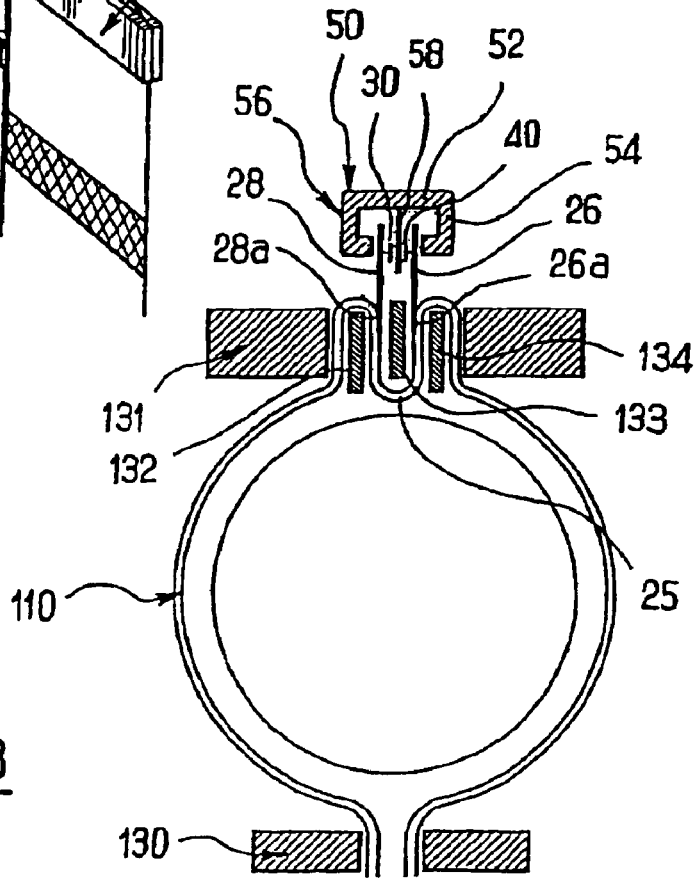
FIG. 3 is a cross-section view of the FIG. 2 embodiment of an automatic forming machine.

The structure of one possible embodiment of a forming machine of the invention is shown in FIG. 2. It is based on the structure of the machine shown in FIG. 1. Elements that are similar in both FIGS. 1 and 2 are given identical reference numerals. Reference is also made to FIG. 3 which is a cross-section view through this first possible embodiment.

Naturally, the closure strips 30, 40 may be implemented in a wide variety of ways. They preferably comprise respective complementary male and female strip members or hooks. Their structure is not described in greater detail below.

In the invention, the closure strips 30, 40 are carried by distinct respective lateral support webs 26, 28.

Similarly, the slides 50 may be embodied in a wide variety of ways. As can be seen in FIG. 3, each slide preferably comprises: a soleplate 52 carrying two lateral flanges 54 and 56 on one face together with a central separating rib 58 which co-operates with the lateral flanges 54 and 56 to define two passages that converge or diverge depending on the direction under consideration, each serving to receive a respective one of the strips 30, 40. The structure of slides suitable for use in the context of the invention is not described in greater detail below.

The pitch at which the slides 50 are placed on the closure assembly 10 is equal to the size of the bags to be formed.

As shown diagrammatically in FIG. 2, the closure assembly 10 is preferably fed longitudinally and is fixed (preferably by heat sealing) via its outer lateral webs 26, 28 on the side that is diametrically opposite the free edges of the film 110 being shaped into a tube.

For this purpose, a loop is made in the moving film in its side substantially opposite from the free edges of the traveling film 110. The loop is substantially W-shaped. This W-shape is imparted by fingers 132, 133, and 134 disposed in an alternating configuration relative to one another. The two fingers 132 and 134 are disposed on the inside surface of the film 110. The finger 133 is interposed between the fingers 132 and 134 and is placed on the outside surface of the film 110. The fingers 132, 133, and 134 are fixed to the structure of the machine, for example.

It is thus possible to fix the closure assembly in the concave portion of the loop on the surface of the film 110 that corresponds to the outside surface of the bag.

Still more precisely, the distinct external support webs 26 and 28 are most preferably heat sealed to the film 110 via their free margins 26*a* and 28*a*.

In addition, in preferred but non-limiting manner, the external webs 26 and 28 are heat sealed to the film 110 by means 131 (FIG. 3) that are distinct from the above-mentioned means 130 for performing the longitudinal heat sealing of the film.

The means 131 need to transfer heat to seal the distinct external support webs 26 and 28 to the film 110 while ensuring that the webs do not become stuck together. It is thus possible to provide means, such as fingers or blades for example, that are interposed between the webs 26 and 28 while they are being sealed to the film 110 by the means 131.

Such means are known to the person skilled in the art and are not described in the present application. They may be formed by the finger 133.

In a variant of the invention, the closure assemblies are fixed before the film travels over the forming throat. FIG. 4 is a section view through a configuration of two fingers 133 and 134 that are partially juxtaposed and that serve to make a fold that is suitable for generating a loop whereby the closure assembly 10 can be fixed to the film 110.

FIG. 5 shows the disposition of the closure assembly 10 on the film 110 prior to traveling over the forming throat. The closure assembly 10 is fixed in this configuration by heat-sealing means similar to the means 131. In the same manner as before, the closure assembly 10 is preferably fixed inside the concave portion of the loop to the surface of the film 110 which corresponds to the outside surface of the bag. Once the closure assembly 10 has been fixed to the film, there is no longer any need to use the finger 133.

Still more precisely, the distinct external support webs 26 and 28 are most preferably heat sealed to the film 110 via their free margins 26*a* and 28*a*.

While the film 110 is traveling over the forming throat, the closure assembly 10 fixed in the concave portion of the loop is raised to match the shape of the tube. This can be assisted by means of the fingers 132 and 134.

The bag can thus be sealed longitudinally by the means 130 as in the first embodiment.

In both cases, whether the closure assembly 10 is fixed while the film is traveling over the forming throat or before it travels thereover, the assembly 10 is cut into bag-sized lengths by conventional cutter means which are preferably associated with the transverse heat-sealing means 140 that individualize the bags.

Also preferably, the closure strips 30, 40 are mutually engaged (closed) while they are being fixed to the film 110. This disposition guarantees proper and accurate positioning of the closure assembly 10 on the film 110.

Nevertheless, the closure strip 30, 40 can subsequently be separated by moving the slides 50 by means of an appropriate tool, should that be necessary.

Where appropriate, pre-seals 60 may also be provided at constant pitch bonding together the complementary closure strips 30, 40 prior to delivery to the automatic bag-forming machine. The pitch of these pre-seals 60 is equal to the size of a bag. Under such circumstances, the closure strips 30, 40 are mutually engaged (closed) between the slide 50 and one of the pre-seals 60 and they are mutually disengaged (open) between the slide 50 and the adjacent other pre-seal 60.

Nevertheless, such pre-seals 60 are not always essential. Naturally, embodiments which avoid using such pre-seals present the advantage of avoiding any need to determine the position of the closure machine relative to the film.

In a variant, a line of weakness or pre-cut can be provided in the surface of the film 110, for example in the middle of the concave portion. Such a pre-cut line is represented under reference 25 in FIGS. 3 and 6.

The sheets 26 and 28 supporting the strips, and the film 110 used in the context of the present invention may be embodied in a wide variety of ways. For example, the film may be a single sheet of thermoplastic material, or it may be a composite thermoplastic film, i.e. comprising a plurality of layers of different kinds in juxtaposition, or indeed it may be a laminated film constituted, for example, by paper coated in a plastics film or in a metallized film.

Naturally, the present invention is not limited to the particular embodiments described above, but extends to any variant within the spirit of the invention.

In yet another variant, it is possible to envisage fixing the closure assembly 10 to the film 110 by means other than the longitudinal jaws 131.

The complementary closure strips 30, 40 may be fitted, e.g. by means of adhesive or heat sealing, to the support sheets 26 and 28, or they may be formed integrally therewith, e.g. by molding.

In a non-limiting embodiment, the width of the external lateral webs 26, 28 can be about 10 millimeters (mm) to 40 mm.

In another advantageous embodiment of the present invention, as shown in FIG. 7, the forming throat 100 is of right section that is polygonal, preferably square. Furthermore, a loop 114 is formed to project outwards from each of the corners of the throat 100. One of these loops 114 is constituted by the join between the two free edges of the film.

These loops 114 are preferably fixed by any suitable heat-sealing or adhesive means via their facing inside surfaces, as shown diagrammatically in FIG. 7.

Furthermore, in the ambit of the present invention, one of these loops 114 is itself provided with a concave portion 116 for receiving the above-described slide-actuated closure assembly in accordance with the present invention. FIG. 7 and FIG. 8 which show a detail of FIG. 7 on a larger scale show such a closure assembly 10 comprising two closure strips 30, 40 carried by distinct lateral support webs 26, 28 respectively, and together fitted with a slide 50. In this case also, the closure assembly is fixed to the outside surface of the loop 116 by means of elements of the support webs 26*a*, 28*a*.

Making bags in accordance with the present invention by means of such loops 114 and a generally square section enables the bags to be stiffened and to be self-supporting in a vertical position on a suitable support.

Where appropriate, in the ambit of the present invention, the outside surface of the film 110 can be provided, at least locally in the fixing zone of the closure assembly 10, and prior to the closure assembly being fixed thereto, with a layer of material suitable for facilitating fixing of the assembly 10, preferably by heat sealing. Such a layer of material may be constituted, for example, by a double-faced strip of adhesive or by a polyethylene-based laminate.

I claim:

1. A method of automatically forming bags fitted with complementary closure strips secured to distinct support webs and associated with an actuating slide, comprising:

at least one film suitable for forming walls of the bags is supplied continuously;

a closure assembly comprising complementary closure strips secured to distinct lateral, support webs which extend beyond the complementary closure strips is supplied continuously, the complementary closure strips being associated with slides for actuating the complementary closure strips, the slides being distributed along a length of the closure assembly as supplied, the closure assembly is fixed via external lateral support webs, to the at least one film forming the walls of the bags; wherein:

a loop is made in the continuously supplied at least one film, and inside a concave portion of the loop, the closure assembly is fixed to a surface of the at least one film that corresponds to an outside surface of the bags.

2. The method according to claim 1, wherein the method is implemented on an automatic bag forming machine in which the bags travel horizontally.

3. The method according to claim 1, wherein the method is implemented on an automatic bag-forming machine in which the bags travel vertically.

4. The method according to claims 1, 2, or 3 wherein the method is implemented on an automatic machine for forming, filling, and sealing bags.

5. The method according to claim 1, wherein the closure assembly is fixed to the surface of the at least one film prior to the film traveling over an automatic bag-forming machine.

6. The method according to claim 1, wherein the loop is made in the at least one film by fingers extending in a mutually alternating configuration so as to impart a substantially W-shaped shape to the loop.

7. The method according to a claim 1, wherein a pitch of the slices along the closure assembly is equal to the size of the bags to be formed.

8. The method according to claim 1, wherein the closure assembly is fed parallel to a travel direction of the at least one film.

9. The method according to claim 1, wherein the complementary closure strips are mutually engaged while the at least one film is being fixed.

10. The method according to claim 1, wherein the closure assembly includes a plurality of pre-seals distributed alone the closure assembly at a constant pitch for bonding together the complementary closure strips prior to being fed to the automatic bag-forming machine.

11. The method according to claim 10, wherein the pitch of the pre-seals is equal to the size of the bags.

12. The method according to claims 10 or 11, wherein the complementary closure strips are mutually engaged between the slide and a first pre-seal and disengaged between the slide and a second adjacent pre-seal.

13. The method according to claim 1, wherein a line of weakness or a pre-cut extends along the surface of the at least one film within the concave portion of the at least one film.

14. The method according to claim 1, wherein the concave portion is a first concave portion, the method further comprising:

shaping the at least one film on a forming throat of substantially polygonal cross-section;

forming a corner loop at each corner of the throat, a second concave portion being formed in one of said corner loops; and fixing the closure assembly in said concave portion.

15. The method according to claim 1, further comprising providing an outside surface of the at least one film, at least in a zone for fixing the closure assembly and prior to the assembly being fixed thereto, with a layer of material for facilitating fixing of the assembly to the at least one flim.

* * * * *